United States Patent [19]

Möhlmann

[11] 4,336,890

[45] Jun. 29, 1982

[54] CAP OR CLOSURE FOR TUBES AND BOTTLES

[75] Inventor: Hans H. Möhlmann, Bremen, Fed. Rep. of Germany

[73] Assignee: Shortland Engineering International Anstalt, Schaan, Liechtenstein

[21] Appl. No.: 160,666

[22] Filed: Jun. 18, 1980

[30] Foreign Application Priority Data

Jul. 3, 1979 [DE] Fed. Rep. of Germany ..... 2926730

[51] Int. Cl.[3] ..... B65D 45/32

[52] U.S. Cl. ..... 215/272; 215/219

[58] Field of Search ..... 215/219, 272

[56] References Cited

U.S. PATENT DOCUMENTS 2,587,737 3/1952 Koster ..... 215/272

3,868,036 2/1975 Wittwer ..... 215/219 X

*Primary Examiner*—George T. Hall

*Attorney, Agent, or Firm*—Merriam, Marshall & Bicknell

[57] ABSTRACT

This disclosure relates to a closure for a tube or bottle. The closure includes a cup-shaped cap that fits over the opening of the tube or bottle, a tubular closure member that is mounted around the cap, and a plurality of ribs that connect the cap and the closure. The cap and the closure are radially spaced and the ribs extend at a slant or pitch angle relative to a radial line. The ribs all slant in one direction when the closure is in the open or at-rest position. To seal the opening, the member is turned angularly to decrease the pitch angle, which action bends or flexes the cap radially inwardly against the tube or bottle. The member is turned sufficiently far to bend the ribs over center so that they slant in the opposite direction, in order to lock the closure on the cap or closure.

25 Claims, 3 Drawing Figures

CAP OR CLOSURE FOR TUBES AND BOTTLES

The invention relates to a detachable closure for closing the opening of an article having a tubular socket-like outlet or opening, such as tubes, bottles, cans, car batteries, etc.

A variety of closure constructions are known in the art having the purpose of closing such articles. For example, tubes which have outlet connections are usually provided with an external thread, and are closed by means of a cup-shaped screw-on cap having a matching internal thread. The thread constitutes the connecting means and in order to provide an adequate seal, a packing or sealing ring, made for example of cork, plastic, etc., is placed in the cap, or a soft packing can be injected.

In addition to the conventional, generally cylindrical corks, crown corks, etc. for sealing bottles, there are detachable snap closures which have, for example, a sealing ring as well as a lever bar, which engages behind the bottle neck and, in the closed state, presses the seal against the front face of the bottle neck around the opening.

Further, closures such as screw caps, plug closures, etc. are known particularly for medicament bottles and the like. Similar closures in the form of screw caps, screw plugs, etc. are, for example, conventionally used for the cells of automobile batteries, oil cans, etc.

A common requirement for all such screw closures is that, to obtain a reliable, tight seal, it is generally necessry to perform a number of rotations or turns of the closure. However, if the closure is not turned until firm sealing engagement takes place, which is particularly the case when this activity is performed by a nonexpert, there is no assurance that there is an adequately tight closure. Furthermore in the case of the known screw closures, a relatively accurate thread must be formed not only on the closure, but also on the article to be closed, which involves considerable costs.

If the openings or outlets of the articles to be closed and/or the known screw closures are made from a material which does not have a particularly high strength, the thread can easily become damaged, so that the closures cannot be fastened or can only be fastened with an inadequate sealing action.

The present invention solves the foregoing problems by an improvement of the known closures of the type described hereinbefore, which avoids their disadvantages while providing a closure that can be manufactured extremely inexpensively as a mass-produced article, and which can be operated by nonexperts in a correct manner so that a sealing connection is obtained when closing an article. In addition, such closing and thereafter opening of the article, can take place much more easily and rapidly.

According to the invention, the problems are solved by providing a closure including a tubular or sleeve-like outer member and an inverted cup-shaped cap member, the cap member being mounted coaxially within the outer member, the two members being radially spaced and connected by a plurality of webs. The webs are preferably angularly spaced at equal angular distances. The webs do not extend exactly radially but instead slant radially and tangentially, the pitch or angle of slant being, for example, 45° from a radial line.

The invention is described in greater detail hereinafter with reference to the accompanying drawings showing illustrative embodiments of the invention, wherein.

Figure 1:
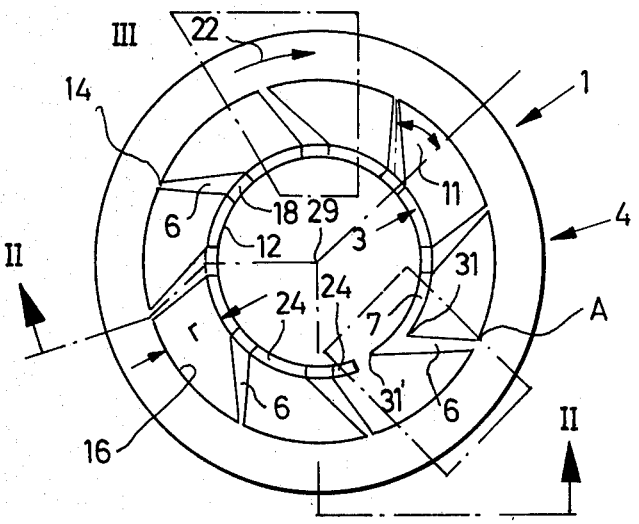
FIG. 1 is a diagrammatic bottom plan view taken on the line 1—1 of FIG. 2, showing a closure according to the invention.
Figure 2:
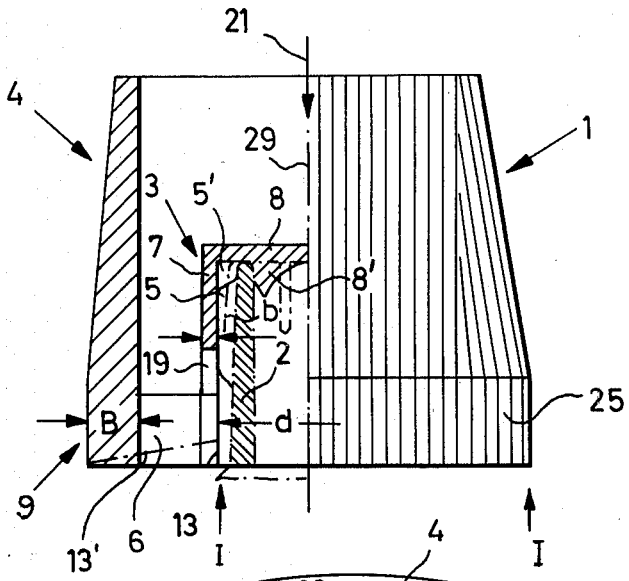
FIG. 2 is a sectional view of the closure taken on the line II—II of FIG. 1.

FIGS. 1 and 2 show a closure 1 for sealing a tube, for example, only the socket or tubular outlet portion 2 of the tube being shown by broken lines in FIG. 2. The closure 1 comprises a cup-shaped cap 3, a sleeve-like tubular closure member 4, and a plurality of connecting webs 6.

The cup-shaped cap 3 essentially comprises a cylindrical outer wall 7 and an end or cover portion 8 formed integrally therewith. An annular centrally located step 8' projects downwardly from the cover portion 8 and it is spaced relative to the inside of wall 7. As shown in FIG. 2, when the outlet 2 is inserted into the closure, the outlet extends between the wall 7 and the bead 8' and the bead 8' preferably fits snugly within the opening. The step 8' is recessed toward the center of the cap as shown in FIG. 2.

As shown in FIG. 2, in the present example the outlet 2 has rib or bead-like steps 5 on its outside, which run substantially parallel to the center line 29 of closure 1. Corresponding steps 5' parallel to the steps 5 are provided on the inside of wall 7, which have a certain radial spacing with respect to the outer wall of outlet 2.

The internal diameter d (FIG. 2) of the wall 7 of cap 3 is, without taking into account steps 5', the same as the external diameter of outlet 2 adjacent its steps 5, so that outlet 2 can be introduced with an eccentric sliding fit into cap 3. The wall 7 of cap 3 is preferably conical towards the cover portion 8, or thicker at its lower end, as shown in the embodiment of FIG. 2.

On its lower edge portion 9 the tubular sleeve-like closure member 4 has a wall thickness B, which is substantially larger or a multiple of the wall 7 thickness b of cap 3. Cap 3, closure member 4 and webs 6 are made from an elastic material such as plastic and are preferably constructed as an integral unit.

As can be seen in FIG. 1, the closure member 4 is arranged with a radial spacing r with respct to the outside of wall 7 of cap 3. In the present example, eight webs 6 connect the cap 3 and closure member 4 and are arranged with a uniform angular spacing of 45° over the periphery and are directed radially at an angle 11, which in this embodiment is 45°.

The lower edge of cap 3 is preferably provided with a chamfer 13 so that it can be mounted in a particularly simple manner on the outlet 2 of the tube. As indicated at the left by a broken line in FIG. 2, this chamfer 13' can also extend over the entire underside of closure 1 in order to ensure particularly easy centering on mounting the closure 1.

As can be seen from the drawing, the webs 6 are triangular, the apex 14 (FIGS. 1 and 3) of the triangle being located on the inside 16 of closure member 4, and the apex 14 consequently forms the connection point between webs 6 on the one hand and closure member 4 on the other.

The wider ends of the webs 6 are arranged on the lower edge portion of the cap 3 and closure member 4 and are consequently positioned on the outside of wall 7 of cap 3 and preferably the wall 7 is recessed at 18 (FIG. 1) below the connecting portion between each web 6 and the wall 7.

In addition, there is a recess in the form of a port or hole 19 (FIG. 2) which completely passes through the wall 7 above the connecting point between each web 6 and the wall 7 of cap 3.

The operation of the closure 1 in accordance with the invention in the embodiment illustrated in the drawings is as follows:

When the outlet connection 2 of the tube is to be closed using the closure 1, the latter is initially mounted from above on the outlet 2 and moved in the direction of the arrow 21 in such a way that steps 5 and 5' are juxtaposed in parallel relation. This is ensured, even if steps 5 and 5' are initially aligned with one another because the bottoms of the steps 5 and the tops of the steps 5' are preferably laterally rounded or chamfered in an inclined manner, so that the desired side-by-side relation is automatically obtained.

In the final mounted position of the closure, the upper end face of the outlet 2 tightly engages on the inside of cover portion 8, and the step 8' on the inside of cover portion 8 extends into the outlet 2.

Figure 3:
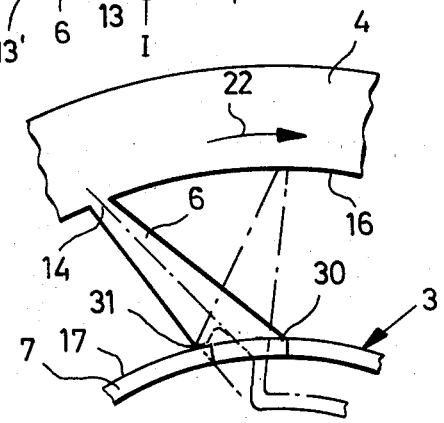
FIG. 3 is an enlarged diagrammatic view of the fragment indicated by the dash-dot-line III of FIG. 1.

In this state the webs 6 and the wall 7 of cap 3 are in the position shown in FIG. 1, which coincides with the position shown by the continuous lines in FIG. 3.

To fasten or secure the closure 1, the closure 1 is turned in the direction of the arrow 22 (FIG. 3) which requires only a fraction of a complete turn. As the closure member 4 is substantially thicker than the wall 7 of cap 3, and due to its continuous wall thickness, it substantially retains its initial configuration and shape, whereas due to the the engagement between the steps 5 and 5' which hold the cap 3 during the rotation in the direction of arrow 22, the webs 6 are pivoted about the apex 14 in the clockwise direction.

As a result of this pivoting movement of webs 6, the ends of the webs located on the wall 7 of cap 3 attempts to pivot about apex 14 on an arc 23 that is related to the web length L, so that the wall of cap 3 adjacent the webs 6 is displaced radially inwards and the periphery of cap 3 is shortened on its lower edge portion. This constriction of the wall 7 below steps 5' locks the closure 1 on the outlet 2. The condition of the wall 7 and the webs 6 are shown in dash-dot lines in FIG. 3.

In the case of a continuous wall 7, i.e. a cap 3 having no ports 19, this bending would be possible only if the wall material were highly elastic. Due to the ports 19 in wall 7, it is possible to use in this case less elastic materials, because the lower edge portion 24 of wall 7 of cap 3 are moved closer together on closing, i.e. on rotating in the peripheral direction in the direction of the arrow 22. As a result, the peripheral spacing of two adjacent edge portions 24 as shown in FIG. 3 is reduced.

During the rotation in the direction of the arrow 22 from the open into the closed position, each web 6 is pivoted past its radial position into a closed position (see the dash-dot lines in FIG. 3), and each web 6 is then at an angle to the radial but on the other side.

As the length L of the webs 6 is greater than the initial radial spacing r (FIG. 1), closure 1 is stable in both its open and closed positions.

Closure 1 may be removed in the converse manner, i.e. it is merely necessary to turn closure 1 by a fraction of a turn counter to the direction of arrow 22.

So that, even in the case of relatively small closures 1, the necessary torque can be applied with only two fingers which may be wet or greasy, the outside of closure member 4 is preferably roughened by knurling 25.

The wall thickness of the closure member 4 preferably decreases upwardly from the lower edge portion, because the wall of closure member 4 in the upper portion is merely intended to provide an adquately large working surface for two fingers. Due to the tubular or sleeve-like configuration, a reduced strength and therefore a reduce wall thickness at the upper end is adequate as compared with what would be the case at the lower edge portion, where the wall of the member 4 must withstand the forces exerted by webs 6 on closing or opening.

In the case of a variant of the above closure described relative to FIGS. 1 and 2, the steps 5 and 5' may be omitted, if the dimensions are such that the internal diameter d of the wall 7 substantially corresponds to the external diameter of outlet 2. In the case of such a construction, due to the friction between the inside of wall 7 and the outside of outlet 2 there is a pivoting action of the webs 6 as described from an open into a closed position, so that a squeezing and fastening action is obtained.

Another variant is shown in the portion A of FIG. 1 framed by dotted lines. In this variation the webs 6 are connected to the wall 7 of cap 3 only by the corner 31, while the other corner 31' is free due to an opening in the wall 7 and can therefore pivot freely radially inwardly behind or below an undercut on the outlet.

While in the example eight webs are provided with a substantially uniform spacing, a different number may be provided and the spacing need not be uniform. If, as is preferred, the closure is made from flexible plastic, the webs can be made integrally with the cup-shaped cap and the tubular closure member. The members 4 and 3 are preferably circular in cross-section and the webs 6 preferably do not extend radially but extend at a pitch angle of, for example, 45°. Th pitch angle is dependent, among other things, on the dimensions of the closure and the characteristics of the selected material, and the angle can be very easily determined in an empirical manner. According to a preferred embodiment of the invention, the thickness of the webs decreases from the closure member to the cap, whereby the webs are constructed in triangular design as seen in a plan view along the axis of the closure. It is particularly advantageous if the wall thickness of the closure member 4, at least in the area of the webs 6, is significantly greater than the wall thickness of the cap, in order to attain the effect described. It is also particularly advantageous if the webs 6 are connected to the lower edge of the cap 3, so that the edge portion of the cap in the vicinity of the connecting point to a web 6 can be weakened by the recesses 18 and the ports 19.

In critical instances where the closure must withstand internal pressures in the article to be closed, the cap 3 can be provided with a seal which may be constructed integrally with the cap or which can be constructed as a separate washer or the like which is fastened within the cap. In order to increase the sealing action and the frictional grip between the closure cap and the article to be closed, it may be advantageous for the cap to be conically tapered from its lower edge to the closed end or cover.

Thus, several variants of the closure according to the invention are possible, whereby inter alia there can be a purely frictional engagement between the cap 3 of closure 1 and the outlet 2, and this is possible in practice if the closure 1 does not have to withstand any significant pressures.

Another important variant, which can be frequently used is to provide rib or bead-like steps 5' on the inside of cap 3 and corresponding steps 5 on the outside of closure member 4 in order to provide an engagement between closure 1 and outlet 2 on starting the actual closing process.

According to another variant the webs are only fixed to the cap by the corner which faces the same, while the other corner is free. Thus, the end portion of the webs facing the outlet 2 can pivot into a relief of the outlet to be closed during the closing process. This variant can be used if the closure has to withstand considerable internal pressures of the article to be closed.

What is claimed is:

1. A closure for releasably closing articles having a wall forming an outlet opening, comprising a cup-shaped cap adapted to be sealingly connected to the outlet and having an internal diameter that is essentially the same as the external diameter of the wall of the article to be closed, a substantially tubular closure member positioned around said cap but having a radial spacing relative to the outside of said cap, and at least one web connecting said cap and said closure member, said web extending at an angle relative to a radial line.

2. A closure according to claim 1, wherein the thickness of said web increases from said closure member to said cap.

3. A closure according to claim 2, wherein said web is substantially triangular.

4. A closure according to claim 1, wherein said web is connected to the lower edge of said cap.

5. A closure according to claim 4, wherein said edge of said cap is weakened in the vicinity of the connection to said web.

6. A closure according to claim 5, wherein said weakening of said edge is provided by a recess.

7. A closure according to claim 1, wherein the thickness of said closure member is substantially greater than the thickness of said cap.

8. A closure according to claim 1, wherein said angle is approximately 45°.

9. A closure according to claim 1 wherein said web is generally elastic.

10. A closure according to claim 1, characterized in that said web is connected only in punctiform manner with said cap.

11. A closure for releasably closing objects such as bottles, canisters, and car batteries formed as a tube having an outlet opening, comprising a substantially cup-shaped cap including a wall having an inner diameter that is adapted to fit around said tube and having a closed position and an open position, said wall when in said closed position being adapted to seal said tube opening, the inner diameter of said wall when in said open position being at least as large as the outer diameter of said tube, and said wall having axial notches directed from the lower rim upwardly, and a closing body arranged coaxially adjacent said cap, said closing body including a sleeve around said cap and webs connecting the inner wall of said sleeve with said cap adjacent said notches, said web, when said wall is in the open position, extending at an acute angle in one direction to the radial, each of said webs being pivotable around an axis which is located substantially at the connecting point between said webs and said cap, each web pivoting over a dead center position to a closing position where it extends at an acute angle in the other direction to the radial and thereby moves said wall to said closed position, said webs being formed in one piece with said sleeve and said cap so that all parts of the closure form one integral unit.

12. A closure according to claim 11, wherein said tube has axial steps formed on its outer surface, and said cap further comprises steps on its inner surface which extend between corresponding steps on said tube.

13. A closure according to claim 11, wherein said wall of said cap is conically tapered towards its closed end.

14. A closure according to claim 11, wherein the thickness of said webs increases from said sleeve towards said wall.

15. A closure according to claim 14, wherein each of said webs has a substantially triangular shape.

16. A closure according to claim 11, wherein said webs are connected with said lower rim of said cap.

17. A closure according to claim 11, wherein the portions of the rim of said caps adjacent said webs are relatively flexible.

18. A closure according to claim 17, wherein the portion of said cap, above the connection with each web is provided with a notch.

19. A closure according to claim 11, wherein the wall thickness of said sleeve is substantially greater than the wall thickness of said wall of said cap.

20. A closure according to claim 11, wherein when said wall is in said open position said webs extend at an angle of substantially 45° to the radial.

21. A closure according to claim 11, wherein said webs are flexible.

22. A closure according to claim 11, wherein said cap and said closing body are made of a plastic material.

23. A closure according to claim 11, wherein each web is connected at only one point with said wall of said cap.

24. A closure according to claim 11, wherein said cap includes a cover portion, and the inner side of said cover portion includes an annular step, the outer diameter of said step corresponding to the inner diameter of the tube to be closed.

25. Closure according to claim 24, wherein said step of said cover portion is recessed towards the center of said cover portion.

* * * * *